US010621920B2

(12) United States Patent
Gao et al.

(10) Patent No.: US 10,621,920 B2
(45) Date of Patent: Apr. 14, 2020

(54) CAPACITOR DETECTION METHOD AND PIXEL DRIVING CIRCUIT

(71) Applicants: BOE TECHNOLOGY GROUP CO., LTD., Beijing (CN); Ordos Yuansheng Optoelectronics Co., Ltd., Inner Mongolia (CN)

(72) Inventors: Hongwei Gao, Beijing (CN); Xiaowei Wang, Beijing (CN); Yaorong Liu, Beijing (CN); Zhihui Jia, Beijing (CN); Yan Zong, Beijing (CN); Ke Zhao, Beijing (CN); Hongxia Yang, Beijing (CN); Guoqing Zhang, Beijing (CN); Pucha Zhao, Beijing (CN); Xiaopeng Bai, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 0 days.

(21) Appl. No.: 16/138,603

(22) Filed: Sep. 21, 2018

(65) Prior Publication Data

US 2019/0237019 A1 Aug. 1, 2019

(30) Foreign Application Priority Data

Jan. 26, 2018 (CN) ..... 2018 1 0078389

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/043* (2013.01); *G09G 2300/0426* (2013.01); *G09G 2330/12* (2013.01)

(58) Field of Classification Search
None
See application file for complete search history.

(56) References Cited

U.S. PATENT DOCUMENTS

2018/0374405 A1* 12/2018 Li ..... G09G 3/006

* cited by examiner

*Primary Examiner* — Kenneth B Lee, Jr.
(74) *Attorney, Agent, or Firm* — Westman, Champlin & Koehler, P.A.

(57) ABSTRACT

A set of measurement voltages having different voltage values are subsequently inputted to a measurement voltage input terminal of the pixel driving circuit, a light emitting state of a light emitting device under each measurement voltage is detected, and it is determined whether a storage capacitor in the pixel driving circuit is normal based on the light emitting state of the light emitting device.

19 Claims, 3 Drawing Sheets

CAPACITOR DETECTION METHOD AND PIXEL DRIVING CIRCUIT

CROSS-REFERENCE TO RELATED APPLICATION

The present application claims a priority of the Chinese patent application No.201810078389.X filed on Jan. 26, 2018, which is incorporated herein by reference in its entirety.

TECHNICAL FIELD

The present disclosure relates to the field of display technology, in particular to a capacitor detection method and a pixel driving circuit.

BACKGROUND

In an existing OLED (Organic Light Emitting Diode) display device, each pixel unit includes at least three sub-pixels, each of which is driven by a pixel driving circuit. In order to satisfy the high requirement for Pixels Per Inch (PPI, the number of pixels per inch) of the OLED display device, pixel drive circuits with high-density are indispensable.

In an array substrate, a storage capacitor may be formed between the an active layer and a gate layer. However, when the active layer and the gate layer of the array substrate are fabricated, some impurities may remain on these layers, so that the flatness of the active layer and the gate layer is not good. At the opposite areas of the active layer and the gate layer (that is at the storage capacitor), the capacitor are likely to be abnormal due to the poor flatness of the active layer and the gate layer. For example, if two electrode plates of a capacitor are short-circuited or the capacitor is reduced, a certain voltage can cause a charge breakdown.

At present, the storage capacitor and the line size in the pixel driving circuit are basically on a micrometer level. In order to detect whether the storage capacitor is abnormal, a microscope is generally used. However, due to the limitation of the film layers of the capacitor, capacitor breakdown cannot be observed by the microscope, and thus it is hard to determine whether the capacitor is abnormal.

SUMMARY

In one aspect, a capacitor detection method applied in a pixel driving circuit includes: sequentially inputting a set of measurement voltages having different voltage values to a measurement voltage input terminal of the pixel driving circuit; detecting a light emitting state of a light emitting device in the pixel driving circuit under each measurement voltage among the set of measurement voltages having different voltage values; and determining whether a storage capacitor in the pixel driving circuit is normal based on the light emitting state of the light emitting device.

In some embodiments of the present disclosure, the determining whether a storage capacitor in the pixel driving circuit is normal based on the light emitting state of the light emitting device includes: when light emitting states of the light emitting device under the set of measurement voltages all meet preset abnormal states, determining that the storage capacitor is abnormal; and when light emitting states of the light emitting device under the set of measurement voltages all meet preset normal states, determining that the storage capacitor is normal.

In some embodiments of the present disclosure, the pixel driving circuit comprises a first reset sub-circuit, a data writing sub-circuit, a compensation sub-circuit, a light emitting control sub-circuit, a driving transistor, a light emitting device, and a storage capacitor, the first reset sub-circuit is respectively connected to a first terminal of the storage capacitor, a second terminal of the storage capacitor, a reset signal terminal, a first power voltage terminal and an initial voltage signal terminal, and configured to reset the first terminal of the storage capacitor to be the initial voltage, reset the second terminal of the storage capacitor to be the first power voltage; the data writing sub-circuit is connected to a gate line, a data line, and the second terminal of the storage capacitor, respectively, and configured to write the data voltage to the second terminal of the storage capacitor; the compensation sub-circuit is respectively connected to the gate line, the driving transistor and the first terminal of the storage capacitor, and configured to write the first power voltage and a threshold voltage of the driving transistor to the first terminal of the storage capacitor; the light emitting control sub-circuit is respectively connected to a light emitting signal terminal EM, a measurement voltage input terminal, the second terminal of the storage capacitor, the driving transistor and the light emitting device, and is configured to write the measurement voltage inputted by the measurement voltage input terminal to the second terminal of the storage capacitor, and control the driving transistor to drive the light emitting device to emit light; a gate electrode of the driving transistor is connected to the first terminal of the storage capacitor, a first electrode of the driving transistor is connected to the first power voltage terminal, and a second electrode of the driving transistor is connected to the light emitting control sub-circuit; and an anode of the light emitting device is connected to the light emitting control sub-circuit, and the cathode of the light emitting device is connected to a second power voltage terminal.

In some embodiments of the present disclosure, the first reset sub-circuit includes a first transistor and a second transistor, a gate electrode of the first transistor is connected to the reset signal terminal, the first electrode of first transistor is connected to the initial voltage signal terminal, and the second electrode of the first transistor is connected to the first terminal of the storage capacitor; and a gate electrode of the second transistor is connected to the reset signal terminal, a first electrode of the second transistor is connected to the first power voltage terminal, and a second electrode of the second transistor is connected to the second terminal of the storage capacitor.

In some embodiments of the present disclosure, the data writing sub-circuit includes a third transistor, a gate electrode of the third transistor is connected to the gate line, a first electrode of the third transistor is connected to the data line, and a second electrode of the third transistor is connected to the second terminal of the storage capacitor.

In some embodiments of the present disclosure, the compensation sub-circuit includes a fourth transistor, a gate electrode of the fourth transistor is connected to the gate line, a first electrode of the fourth transistor is connected to the second electrode of the driving transistor, and a second electrode of the fourth transistor is connected to the first terminal of the storage capacitor.

In some embodiments of the present disclosure, the light emitting control sub-circuit includes a fifth transistor and a sixth transistor, a gate electrode of the fifth transistor is connected to the light emitting signal terminal, a first electrode of the fifth transistor is connected to the measurement voltage input terminal, and a second electrode of the fifth transistor is connected to the second terminal of the storage capacitor; and a gate electrode of the sixth transistor is connected to the light emitting signal terminal, a first electrode of the sixth transistor is connected to the second electrode of the driving transistor, and a second electrode of the sixth transistor is connected to the anode of the light emitting device.

In some embodiments of the present disclosure, the first transistor, the second transistor, the third transistor, the fourth transistor, the fifth transistor, the sixth transistor and the driving transistor are all P type transistors.

In some embodiments of the present disclosure, the pixel driving circuit further includes a second reset sub-circuit, the second reset sub-circuit includes a seventh transistor, and a gate electrode of the seventh transistor is connected to the gate line, a first electrode of the seventh transistor is connected to the initial voltage signal terminal, and a second electrode of the seventh transistor is connected to the anode of the light emitting device.

In some embodiments of the present disclosure, the detecting a light emitting state of a light emitting device in the pixel driving circuit under each measurement voltage among the set of measurement voltages having different voltage values includes: at a first stage, resetting, by the first reset sub-circuit, the first terminal of the storage capacitor to the initial voltage and the second terminal of the storage capacitor to the first power voltage; at a second stage, writing, by the data writing sub-circuit, the data voltage to the second terminal of the storage capacitor, and writing, by the compensation sub-circuit, the first power voltage and the threshold voltage of the driving transistor to the first terminal of the storage capacitor; and at a third stage, writing, by the light emitting control sub-circuit, the measurement voltage inputted through the measurement voltage input terminal to the second terminal of the storage capacitor, and adjusting the gate voltage of the driving transistor to detect the light emitting state of the light emitting device.

In some embodiments of the present disclosure, the writing, by the light emitting control sub-circuit, the measurement voltage inputted through the measurement voltage input terminal to the second terminal of the storage capacitor, and adjusting the gate voltage of the driving transistor to detect the light emitting state of the light emitting device includes: if the storage capacitor is abnormal, the storage capacitor transferring the measurement voltage to the gate electrode of the driving transistor, when the difference between the measurement voltage and the first power voltage is smaller than the threshold voltage of the driving transistor, driving, by the driving transistor, the light emitting device to emit light under the control of the light emitting control sub-circuit, when the difference between the measurement voltage and the first power-supply voltage is greater than the threshold voltage of the driving transistor, the light emitting device not emitting light.

In some embodiments of the present disclosure, the writing, by the light emitting control sub-circuit, the measurement voltage inputted through the measurement voltage input terminal to the second terminal of the storage capacitor, and adjusting the gate voltage of the driving transistor to detect the light emitting state of the light emitting device includes: if the storage capacitor is normal, the storage capacitor transferring the measurement voltage, the data voltage, the first power voltage, and the threshold voltage of the driving transistor to the gate electrode of the driving transistor, when the difference between the measurement voltage and the data voltage is less than zero, the driving transistor driving the light emitting device to emit light under the control of the light emitting control sub-circuit; when the difference between the measurement voltage and the data voltage is greater than zero, the light emitting device not emitting light.

In some embodiments of the present disclosure, among the set of the measurement voltages having different voltage, there is at least one measurement voltage having a voltage value smaller than a sum of the first power voltage and the threshold voltage of the driving transistor and larger than the data voltage; or there is at least one measurement voltage having a voltage value larger than a sum of the first power voltage and the threshold voltage of the driving transistor and smaller than the data voltage.

In another aspect, a pixel driving circuit includes a first reset sub-circuit, a data writing sub-circuit, a compensation sub-circuit, a light emitting control sub-circuit, a driving transistor, a light emitting device, and a storage capacitor, the first reset sub-circuit is respectively connected to a first terminal of the storage capacitor, a second terminal of the storage capacitor, a reset signal terminal, a first power voltage terminal and an initial voltage signal terminal, and configured to reset the first terminal of the storage capacitor to be the initial voltage, reset the second terminal of the storage capacitor to be the first power voltage; the data writing sub-circuit is connected to a gate line, a data line, and the second terminal of the storage capacitor, respectively, and configured to write the data voltage to the second terminal of the storage capacitor; the compensation sub-circuit is respectively connected to the gate line, the driving transistor and the first terminal of the storage capacitor, and configured to write the first power voltage and a threshold voltage of the driving transistor to the first terminal of the storage capacitor; the light emitting control sub-circuit is respectively connected to a light emitting signal terminal EM, a measurement voltage input terminal, the second terminal of the storage capacitor, the driving transistor and the light emitting device, and is configured to write the measurement voltage inputted by the measurement voltage input terminal to the second terminal of the storage capacitor, and control the driving transistor to drive the light emitting device to emit light; a gate electrode of the driving transistor is connected to the first terminal of the storage capacitor, a first electrode of the driving transistor is connected to the first power voltage terminal, and a second electrode of the driving transistor is connected to the light emitting control sub-circuit; and an anode of the light emitting device is connected to the light emitting control sub-circuit, and the cathode of the light emitting device is connected to a second power voltage terminal, a set of measurement voltages having different voltage values are inputted to a measurement voltage input terminal of the pixel driving circuit, a light emitting state of a light emitting device under each measurement voltage is detected, and it is determined whether a storage capacitor in the pixel driving circuit is normal based on the light emitting state of the light emitting device.

DETAILED DESCRIPTION OF THE EMBODIMENTS

In order to make the objects, the technical solutions and the advantages of the present disclosure more apparent, the present disclosure will be described hereinafter in a clear and complete manner in conjunction with the drawings and embodiments.

Figure 1:
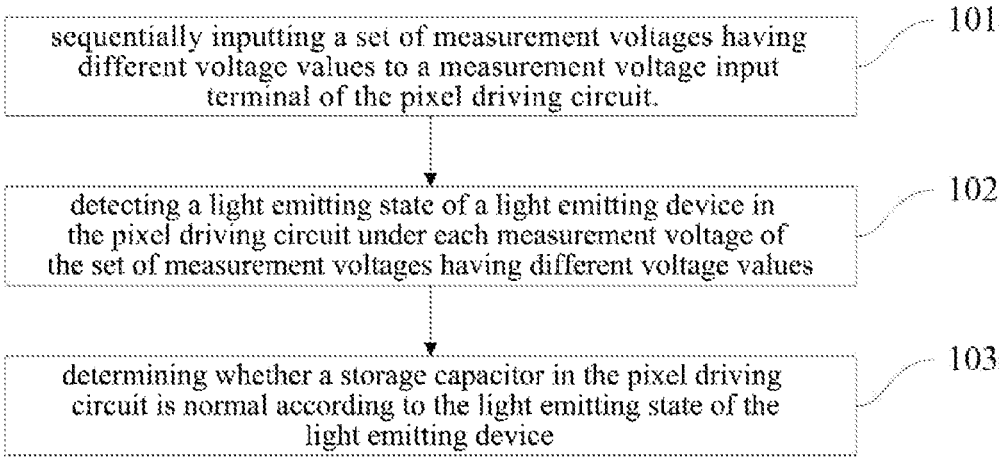
FIG. 1 is a flowchart of a capacitor detection method according to some embodiments of the present disclosure.

FIG. 1 shows a flowchart of a capacitor detection method provided by some embodiments of the present disclosure, it includes the following steps.

Step 101: sequentially inputting a set of measurement voltages having different voltage values to a measurement voltage input terminal of the pixel driving circuit.

In the embodiments of the present disclosure, after the pixel driving circuit is formed in the array substrate, in order to detect whether the storage capacitor in the pixel driving circuit is abnormal, a set of measurement voltages Vref having different voltage values are sequentially inputted to the measurement voltage input terminal Ref of the pixel driving circuit in the display panel.

For example, the voltage values of the measurement voltages Vref being sequentially inputted are 0V, 2V, 4V, and 6V, respectively.

Step 102: detecting a light emitting state of the light emitting device in the pixel driving circuit under each measurement voltage of the set of measurement voltages having different voltage values.

In the embodiment of the present disclosure, the operation timing of the pixel driving circuit is not changed, and each device in the pixel driving circuit is normally driven according to the operation timing of the pixel driving circuit. When a measurement voltage Vref is inputted to the measurement voltage input terminal Ref of the pixel driving circuit, the switching degree of a driving transistor in the pixel driving circuit is controlled by the voltage value of the measurement voltage Vref, thereby controlling the light emitting state of the light emitting device, the light emitting states includes emitting light and not emitting light.

A set of measurement voltages Vref having different voltage values are respectively inputted to the measurement voltage input terminal Ref of the pixel driving circuit, so as to respectively control the light emitting state of the light emitting device in the pixel driving circuit through the voltage values of the set of measurement voltages Vref, and detect the light emitting state of the light emitting device in the pixel driving circuit under each measurement voltage.

For example, when the voltage value of the measurement voltage Vref is 0V, it is detected that the light emitting device in the pixel driving circuit emits light; when the voltage value of the measurement voltage Vref is 2V, it is detected that the light emitting device in the pixel driving circuit emits light; when the voltage value of the measurement voltage Vref is 4V, it is detected that the light emitting device in the pixel driving circuit does not emit light; when the voltage value of the measurement voltage Vref is 6V, it is detected that the light emitting device in the pixel driving circuit does not emit light.

Step 103: determining whether a storage capacitor in the pixel driving circuit is normal according to a light emitting state of the light emitting device.

In the embodiment of the present disclosure, it is determined whether the storage capacitor in the pixel driving circuit is normal under each measurement voltage Vref according to the detected light emitting state of the light emitting device in the pixel driving circuit.

In the embodiment of the present disclosure, a set of measurement voltages having different voltage values are sequentially inputted to the measurement voltage input terminal of the pixel driving circuit, and the light emitting state of the light emitting device in the pixel driving circuit under each measurement voltage is detected, and it is determined whether the storage capacitor in the pixel driving circuit is normal according to the light emitting state of the light emitting device. Without changing the operation timing of the pixel driving circuit, the measurement voltage inputted by the measurement voltage input terminal is changed, and the degree of switching of the driving transistor is controlled by the voltage value of the measurement voltage, thereby controlling whether the light emitting device emits light. It is determined whether the storage capacitor in the pixel driving circuit is normal based on the light emitting state of the light emitting device, and the electrical defect caused by the abnormality of the film layer of the capacitor can be quickly detected, and the efficiency of capacitor detection is improved.

Figure 2:
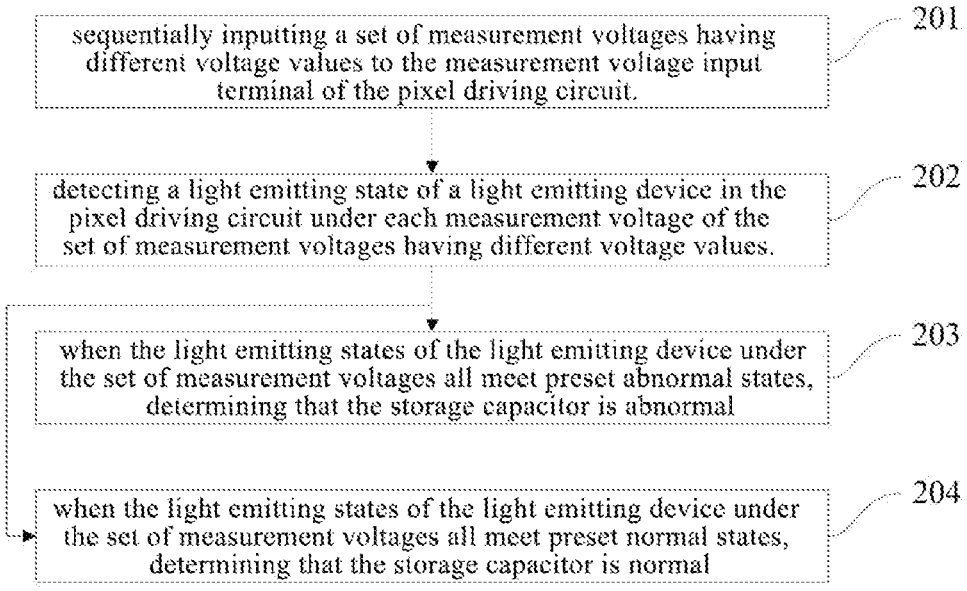
FIG. 2 is a flowchart of a capacitor detection method according to some embodiments of the present disclosure.

FIG. 2 shows a flowchart of a capacitor detection method according to some embodiments of the present disclosure, it includes the following steps.

Step 201: sequentially inputting a set of measurement voltages having different voltage values to the measurement voltage input terminal of the pixel driving circuit.

Figure 3:
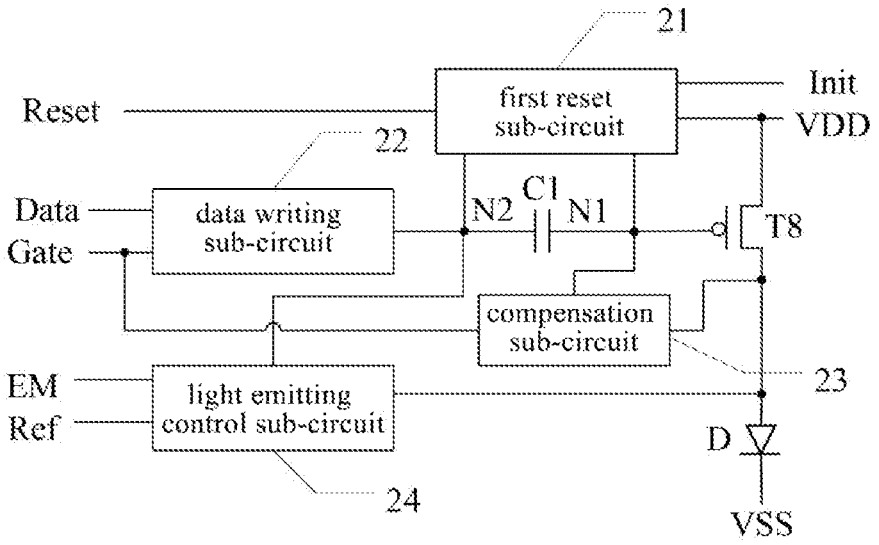
FIG. 3 is a schematic diagram of a pixel driving circuit provided by some embodiments of the present disclosure.

FIG. 3 shows a schematic diagram of a pixel driving circuit according to some embodiments of the present disclosure. Measurement voltages Vref having different voltage values are sequentially inputted to the measurement voltage input terminal Ref of the pixel driving circuit to detect whether the storage capacitor C1 in the pixel driving circuit is normal.

The pixel driving circuit includes a first reset sub-circuit 21, a data writing sub-circuit 22, a compensation sub-circuit 23, a light emitting control sub-circuit 24, a driving transistor T8, a light emitting device D, and a storage capacitor C1.

The first reset sub-circuit 21 is respectively connected to a first terminal N1 of the storage capacitor C1, a second terminal N2 of the storage capacitor C1, the reset signal terminal Reset, a first power voltage terminal VDD and an initial voltage signal terminal Init, and configured to reset the first terminal N1 of C1 to be the initial voltage Vinit, reset the second terminal N2 of the storage capacitor C1 to be the first power voltage Vdd.

The data writing sub-circuit 22 is connected to a gate line Gate, a data line Data, and the second terminal N2 of the storage capacitor C1, respectively, and configured to write the data voltage Vdata to the second terminal N2 of the storage capacitor C1.

The compensation sub-circuit 23 is respectively connected to the gate line Gate, the driving transistor T8 and the first terminal N1 of the storage capacitor C1, and configured to write the first power voltage Vdd and a threshold voltage Vth of the driving transistor T8 to the first terminal N1 of the storage capacitor C1.

The light emitting control sub-circuit 24 is respectively connected to a light emitting signal terminal EM, a measurement voltage input terminal Ref, the second terminal N2 of the storage capacitor C1, the driving transistor T8 and the light emitting device D, and is configured to write the measurement voltage Vref inputted by the measurement voltage input terminal Ref to the second terminal N2 of the storage capacitor C1, and control the driving transistor T8 to drive the light emitting device D to emit light.

The gate electrode of the driving transistor T8 is connected to the first terminal N1 of the storage capacitor C1, the first electrode of the driving transistor T8 is connected to the first power voltage terminal VDD, and the second electrode of the driving transistor T8 is connected to the light emitting control sub-circuit 24.

The anode of the light emitting device D is connected to the light emitting control sub-circuit 24, and the cathode of the light emitting device D is connected to a second power voltage terminal VSS.

Step 202: detecting a light emitting state of the light emitting device in the pixel driving circuit under each measurement voltage of the set of measurement voltages having different voltage values.

In the embodiments of the present disclosure, a set of measurement voltages Vref having different voltage values are respectively inputted to the measurement voltage input terminal Ref of the pixel driving circuit, so as to respectively control the light emitting state of light emitting device D in the pixel driving circuit based on the voltage value of the set of measurement voltages Vref. The light emitting state of the light emitting device D in the pixel driving circuit under each measurement voltage is detected.

Figure 4:
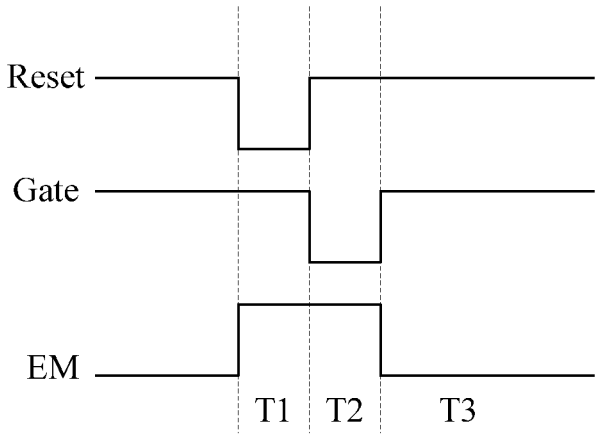
FIG. 4 is a timing chart showing the operation of a pixel driving circuit according to some embodiments of the present disclosure.

FIG. 4 shows an operation timing diagram of a pixel driving circuit according to some embodiments of the present disclosure.

At a first stage T1, a reset signal inputted by the reset signal terminal Reset is enabled, so that the first reset sub-circuit 21 is turned on, and the first reset sub-circuit 21 resets the first terminal N1 of the storage capacitor C1 to the initial voltage Vinit and the second terminal N2 of the storage capacitor C1 to the first power voltage Vdd under the control of reset signal.

At a second stage T2, a gate signal inputted by the gate line Gate is enabled, so that the data writing sub-circuit 22 and the compensation sub-circuit 23 are turned on, and the data writing sub-circuit 22 writes the data voltage Vdata to the second terminal N2 of the storage capacitor C1, and the compensation sub-circuit 23 writes the first power voltage Vdd and the threshold voltage Vth of the driving transistor T8 to the first terminal N1 of the storage capacitor C1 under the control of the gate signal.

At a third stage T3, a light emitting signal inputted by the light emitting signal terminal EM is enabled, so that the light emitting control sub-circuit 24 is turned on, and under the control of the light emitting signal, the light emitting control sub-circuit 24 writes the measurement voltage Vref inputted through the measurement voltage input terminal Ref to the second terminal N2 of the storage capacitor C1, and adjusts the gate voltage Vg of the driving transistor T8 to detect the light emitting state of the light emitting device D.

The measurement voltage Vref is inputted to the measurement voltage input terminal Ref without changing the operation timing of the pixel drive circuit, and the switching degree of the drive transistor T8 is controlled by the voltage value of the measurement voltage Vref, thereby controlling whether the light emitting device D emits light, and further determining whether the storage capacitor C1 in the pixel drive circuit is normal based on the light emitting state of the light emitting device D .

Figure 5:
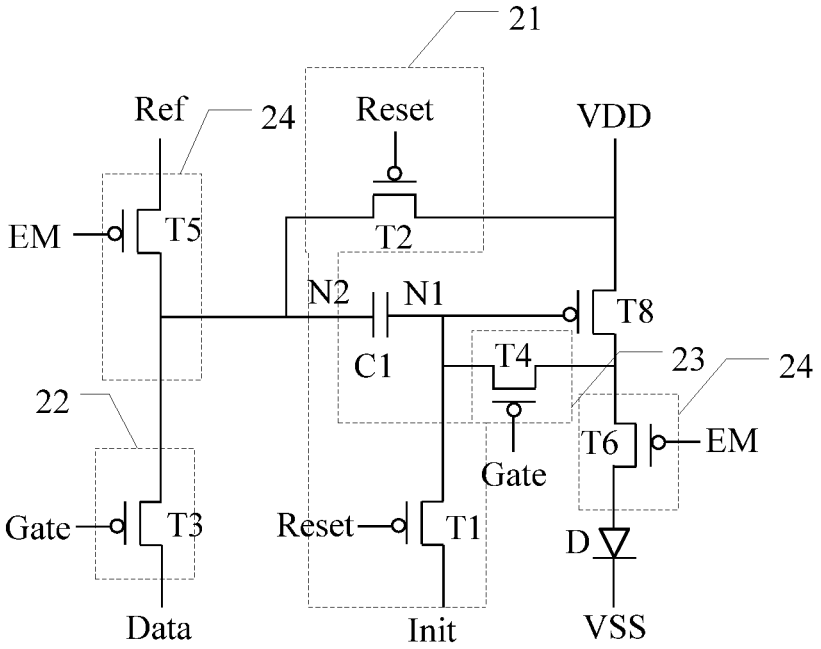
FIG. 5 is a circuit diagram of a pixel driving circuit according to some embodiments of the present disclosure.

FIG. 5 shows a circuit diagram of a pixel driving circuit provided by some embodiments of the present disclosure.

In the pixel driving circuit, the first reset sub-circuit 21 includes a first transistor T1 and a second transistor T2. A gate electrode of the first transistor T1 is connected to the reset signal terminal Reset, the first electrode of first transistor T1 is connected to the initial voltage signal terminal Init, and the second electrode of the first transistor T1 is connected to the first terminal N1 of the storage capacitor C1; the gate electrode of the second transistor T2 is connected to the reset signal terminal Reset, the first electrode of the second transistor T2 is connected to the first power voltage terminal VDD, and the second electrode of the second transistor T2 is connected to the second terminal N2 of the storage capacitor C1.

The data writing sub-circuit 22 includes a third transistor T3, a gate electrode of the third transistor T3 is connected to the gate line Gate, the first electrode of the third transistor T3 is connected to the data line Data, and the second electrode of the third transistor T3 is connected to the second terminal N2 of the storage capacitor C1.

The compensation sub-circuit 23 includes a fourth transistor T4, a gate electrode of the fourth transistor T4 is connected to the gate line Gate, the first electrode of the fourth transistor T4 is connected to the second electrode of the driving transistor T8, and the second electrode of the fourth transistor T4 is connected to the first terminal N1 of the storage capacitor C1.

The light emitting control sub-circuit 24 includes a fifth transistor T5 and a sixth transistor T6. The gate electrode of the fifth transistor T5 is connected to the light emitting signal terminal EM, the first electrode of the fifth transistor T5 is connected to the measurement voltage input terminal Ref, and the second electrode of the fifth transistor T5 is connected to the second terminal N2 of the storage capacitor C1. The gate electrode of the sixth transistor T6 is connected to the light emitting signal terminal EM, the first electrode of the sixth transistor T6 is connected to the second electrode of the driving transistor T8, and the second electrode of the sixth transistor T6 is connected to the anode of the light emitting device D.

The operation of the pixel driving circuit shown in FIG. 5 will be briefly described below with reference to the operation timing chart shown in FIG. 4.

At the first stage T1, the reset signal inputted by the reset signal terminal Reset is at a low level, the gate signal inputted by the gate line Gate is at a high level, and the light emitting signal inputted by the light emitting signal terminal EM is at a high level, the first transistor T1 and the second transistor T2 are turned on under the control of the reset signal. The first transistor T1 resets the first terminal N1 of the storage capacitor C1 to the initial voltage Vinit, and the second transistor T2 resets the second terminal N2 of the storage capacitor C1 to the first power voltage Vdd. At this time, the driving transistor T8 is turned on, but since the sixth transistor T6 is in the off state, the light emitting device D does not emit light.

At the second stage T2, the reset signal inputted by the reset signal terminal Reset is at a high level, the gate signal inputted by the gate line Gate is at a low level, and the light emitting signal inputted by the light emitting signal terminal EM is at a high level, and the third transistor T3 and the fourth transistor T4 are turned on under the control of the gate signal, the third transistor T3 writes the data voltage Vdata to the second terminal N2 of the storage capacitor C1, and the fourth transistor T4 charges the storage capacitor C1 until the gate voltage Vg of the driving transistor T8 minus the source voltage Vs (at the first phase Vs=Vdd) is equal to the threshold voltage Vth, the voltage of the first terminal N1 of the storage capacitor C1 can be charged to Vdd+Vth, and the voltage at the storage capacitor C1 is Vdd+Vth−Vdata.

At the third stage T3, the reset signal inputted by the reset signal terminal Reset is at a high level, the gate signal inputted by the gate line Gate is at a high level, the light emitting signal inputted by the light emitting signal terminal EM is at a low level, the fifth transistor T5 and the sixth transistor T6 are turned on under the control of the light emitting signal, and the fifth transistor T5 writes the measurement voltage Vref inputted from the measurement voltage input terminal Ref to the second terminal N2 of the storage capacitor C1, and then VN2=Vref.

If the storage capacitor C1 is abnormal, the storage capacitor C1 transfers the measurement voltage Vref to the gate electrode of the driving transistor T8. When the difference between the measurement voltage Vref and the first power voltage Vdd is smaller than the threshold voltage Vth of the driving transistor T8, the driving transistor T8 drives the light emitting device D to emit light under the control of the light emitting control sub-circuit 24. When the difference between the measurement voltage Vref and the first power-supply voltage Vdd is greater than the threshold voltage Vth of the driving transistor T8, the light emitting device D does not emit light.

When the two electrode plates of the storage capacitor C1 are broke down, that is, when the storage capacitor C1 is abnormal, the voltage VN1 of the first terminal N1 of the storage capacitor C1 is equal to the voltage VN2 of the second terminal N2 of the storage capacitor C1, that is, VN1=VN2=Vref. The gate voltage Vg of the driving transistor T8 is equal to the voltage VN1 of the first terminal N1 of the storage capacitor C1, and the gate voltage of the driving transistor T8 is directly controlled by the measurement voltage Vref, and the gate-source voltage of the driving transistor T8 is Vgs=VN1−Vdd=Vref−Vdd. When the gate-source voltage Vgs of the driving transistor T8 is smaller than the threshold voltage Vth of the driving transistor T8, that is, when the difference between the measurement voltage Vref and the first power-supply voltage Vdd is smaller than the threshold voltage Vth of the driving transistor T8, the driving transistor T8 is turned on, the sixth transistor T6 is used to control the light emitting device D to emit light. That is the sixth transistor T6 is turned on, the driving transistor T8 can drive the current to flow through the light emitting device D, thereby driving the light emitting device D to emit light. When the gate-source voltage Vgs of the driving transistor T8 is greater than the threshold voltage Vth of the driving transistor T8, that is when the difference between the measurement voltage Vref and the first power voltage Vdd is greater than the threshold voltage Vth of the driving transistor T8, the driving transistor T8 is turned off, even if the sixth transistor T6 is turned on, the light emitting device D does not emit light.

It should be noted that when the storage capacitor C1 is abnormal, the gate voltage Vg of the driving transistor T8 is equal to the measurement voltage Vref. In order to prevent the damage of the driving transistor T8 caused by too high gate voltage Vg, the voltage value of the measurement voltage Vref is generally within 0-10V.

If the storage capacitor C1 is normal, the storage capacitor C1 transfers the measurement voltage Vref, the data voltage Vdata, the first power voltage Vdd, and the threshold voltage Vth of the driving transistor T8 to the gate electrode of the driving transistor T8, when the difference between the measurement voltage Vref and the data voltage Vdata is less than zero, the driving transistor T8 drives the light emitting device D to emit light under the control of the light emitting control sub-circuit 24; when the difference between the measurement voltage Vref and the data voltage Vdata is greater than zero, the light emitting device D does not emit light.

When the two electrode plates of the storage capacitor C1 are not broken down, that is, when the storage capacitor C1 is normal, the voltage of the first terminal N1 of the storage capacitor C1 is VN1=Vref−Vdata+Vth+Vdd, and the gate voltage Vg of the driving transistor T8 is equal to the voltage VN1 of the first terminal N1 of the storage capacitor C1, the gate-source voltage of the driving transistor T8 Vgs=VN1−Vdd=Vref−Vdata+Vth, and when the gate-source voltage Vgs of the driving transistor T8 is smaller than the threshold voltage Vth of the driving transistor T8, that is when the difference between the measurement voltage Vref and the data voltage Vdata is less than zero, the driving transistor T8 is turned on, and the sixth transistor T6 is used to control the light emitting device D to emit light, that is, when the sixth transistor T6 is turned on, the driving transistor T8 can drive the current to flow through the light emitting device D, and further drive the light emitting device D to emit light; when the gate-source voltage Vgs of the driving transistor T8 is greater than the threshold voltage Vth of the driving transistor T8, that is, when the difference between the measurement voltage Vref and the data voltage Vdata is greater than zero, the driving transistor T8 is turned off, even if the sixth transistor T6 is turned on, the light emitting device D does not emit light.

For example, the measurement voltage Vref inputted by the measurement voltage input terminal Ref is 3V, the initial voltage Vinit inputted by the initial voltage signal terminal Init is −3V, the data voltage Vdata inputted by the data line Data is 2.2V, and the power voltage Vdd inputted by the first power voltage terminal VDD input is 4.6V, a second power voltage Vss inputted by the second power voltage terminal VSS is −4.4V, and a threshold voltage Vth of the driving transistor T8 is −1.3V. When the storage capacitor C1 is abnormal, VN1=VN2=Vref=3V, the gate-source voltage of the driving transistor T8 is Vgs=VN1−Vdd=3-4.6V=−1.6V, the gate-source voltage of the driving transistor T8 is smaller than the threshold voltage of the driving transistor T8, and the driving transistor T8 is in an On state. When the storage capacitor C1 is normal, VN2=Vref=3V, VN1=Vref−Vdata+Vth+Vdd=3-2.2+(−1.3)+4.6V=4.1V, the gate-source voltage Vgs of the driving transistor T8 is Vgs=VN1−Vdd=4.1-4.6V=−0.5V, the gate-source voltage of the driving transistor T8 is larger than the threshold voltage of the driving transistor T8, and the driving transistor T8 is in the Off state. It can be seen that when the storage capacitor C1 is normal and abnormal, the driving transistor T8 is in different states, that are Off or On state. When the driving transistor T8 is turned on, the light emitting device D can be driven to emit light under the control of the sixth transistor T6; when the driving transistor T8 is turned off, the light emitting device D does not emit light. Whether the storage capacitor C1 is normal or not is determined according to the light emitting state of the light emitting device D under different measurement voltages Vref.

According to the above analysis method, a normal state table of the light emitting device can be calculated in advance when the storage capacitor is normal, and an abnormal state table of the light emitting device can be calculated in advance when the storage capacitor is abnormal.

In order to accurately detect whether the storage capacitor C1 is normal, among the set of the measurement voltages having different voltage values, there is at least one measurement voltage having a voltage value smaller than a sum of the first power voltage Vdd and the threshold voltage Vth of the driving transistor T8, and greater than the measurement voltage of the data voltage Vdata; or there is at least one measurement voltage having a voltage value greater than a sum of the first power voltage Vdd and the threshold voltage Vth of the driving transistor T8, and smaller than the measurement voltage of the data voltage Vdata.

Among the set of the measurement voltages Vref having different voltage values inputted to the measurement voltage input terminal Ref of the pixel driving circuit, there is at least one measurement voltage Vref having a voltage value smaller than a sum of the first power voltage Vdd and the threshold voltage Vth of the driving transistor T8, that is, the difference between the measurement voltage Vref and the first power voltage Vdd is smaller than the threshold voltage Vth of the driving transistor T8. At this time, if the storage capacitor C1 is abnormal, the light emitting device D is driven to emit light; meanwhile, the measurement voltage Vref is greater than the data voltage Vdata. That is, the difference between the measurement voltage Vref and the data voltage Vdata is greater than zero. At this time, if the storage capacitor C1 is normal, the light emitting device D does not emit light.

Alternatively, among the set of the measurement voltages Vref having different voltage values inputted to the measurement voltage input terminal Ref of the pixel driving circuit, there is at least one measurement voltage Vref having a voltage value greater than a sum of the first power voltage Vdd and the threshold voltage Vth of the driving transistor T8. That is, the difference between the measurement voltage Vref and the first power voltage Vdd is greater than the threshold voltage Vth of the driving transistor T8. At this time, if the storage capacitor C1 is abnormal, the light emitting device D does not emit light. Meanwhile, the measurement voltage Vref is smaller than the data voltage Vdata, the difference between the measurement voltage Vref and the data voltage Vdata is less than zero. At this time, if the storage capacitor C1 is normal, the light emitting device D emits light.

It should be noted that, among the set of measurement voltages Vref having different voltage values, there is at least one measurement voltage Vref having a voltage value that is related to the sum of the first power voltage Vdd and the threshold voltage Vth of the driving transistor T8, and the data voltage Vdata. When the sum of the first power voltage Vdd and the threshold voltage Vth of the driving transistor T8 is greater than the data voltage Vdata, at least one measurement voltage Vref is inputted and has a voltage value smaller than the sum of the first power voltage Vdd and the threshold voltage Vth of the driving transistor T8, and greater than the data voltage Vdata. When the sum of the first power voltage Vdd and the threshold voltage Vth of the driving transistor T8 is smaller than the data voltage Vdata, at least one measurement voltage Vref is inputted and has a voltage value greater than the sum of the first power voltage Vdd and the threshold voltage Vth of the driving transistor T8, and smaller than the data voltage Vdata. Based on the light emitting state of the light emitting device D, it can be determined whether the storage capacitor C1 is normal.

In an embodiment of the present disclosure, in order to detect the storage capacitor is normal or abnormal, a set of measurement voltages Vref having different voltage values may be set. For each measurement voltage Vref, other related voltage values may be fixed, for example, the voltage values of the initial voltage Vinit, the data voltage Vdata, the first power voltage Vdd, and the second power voltage Vss are constant. That is, the voltage value of the measurement voltage Vref is variable and other voltage values are constant.

The voltage values inputted each time are shown in Table 1:

TABLE 1

| No. | Vref | Vinit | Vdata | Vdd | Vss |
|---|---|---|---|---|---|
| 1 | 0 | −4.4 | 0 | 4.6 | −4.4 |
| 2 | 2 | −4.4 | 0 | 4.6 | −4.4 |
| 3 | 4 | −4.4 | 0 | 4.6 | −4.4 |
| 4 | 6 | −4.4 | 0 | 4.6 | −4.4 |

According to the above analysis process, if the threshold voltage Vth of the driving transistor T8 is −1.3V, at the first time, the measurement voltage Vref is 0V, the initial voltage Vinit is −4.4V, the data voltage Vdata is 0V, and the first power voltage Vdd is 4.6V, the second power voltage Vss is −4.4V. When the storage capacitor C1 is normal, the gate voltage Vg of the driving transistor T8 is Vg=Vref−Vdata+Vth+Vdd=3.3V, and the gate-source voltage of the driving transistor T8 is Vgs=Vref−Vdata+Vth=−1.3V, the gate-source voltage Vgs is equal to the threshold voltage Vth, the driving transistor T8 is in a critical conduction state, and the light emitting device D is in a critical light emitting state. When the storage capacitor C1 is abnormal, the gate voltage Vg of the driving transistor T8 is Vg=VN1=Vref=0V, the gate-source voltage Vgs of the driving transistor T8 is Vgs=Vref−Vdd=−4.6V, the gate-source voltage Vgs is smaller than the threshold voltage Vth, the driving transistor T8 is in an on state, and the light emitting device D emits light.

At the second time, the measurement voltage Vref is 2V, the initial voltage Vinit is −4.4V, the data voltage Vdata is 0V, the first power voltage Vdd is 4.6V, and the second power voltage Vss is −4.4V. When the storage capacitor C1 is normal, the gate voltage of the driving transistor T8 is Vg=5.3 V, the gate-source voltage of the driving transistor T8 is Vgs=0.7V, the gate-source voltage Vgs is greater than the threshold voltage Vth, the driving transistor T8 is in the off state, and the light emitting device D does not emit light. When the storage capacitor C1 is abnormal, the gate voltage Vg of the driving transistor T8 is 2V, the gate-source voltage Vgs of the driving transistor T8 is −2.6V, the gate-source voltage Vgs is smaller than the threshold voltage Vth, the driving transistor T8 is in an on state, and the light emitting device D emits light.

At the third time, the measurement voltage Vref is 4V, the initial voltage Vinit is −4.4V, the data voltage Vdata is 0V, the first power voltage Vdd is 4.6V, and the second power voltage Vss is −4.4V. When the storage capacitor C1 is normal, the gate voltage Vg of the driving transistor T8 is 7.3V, the gate-source voltage of the driving transistor T8 is Vgs=2.7V, the gate-source voltage Vgs is greater than the threshold voltage Vth, the driving transistor T8 is in the off state, and the light emitting device D does not emit light. When the storage capacitor C1 is abnormal, the gate voltage Vg of the driving transistor T8 is 4 V, the gate-source voltage Vgs of the driving transistor T8 is −0.6 V, the gate-source voltage Vgs is larger than the threshold voltage Vth, the driving transistor T8 is in an off state, and the light emitting device D does not emit light.

At the fourth time, the measurement voltage Vref is 6V, the initial voltage Vinit is −4.4V, the data voltage Vdata is 0V, the first power voltage Vdd is 4.6V, and the second power voltage Vss is −4.4V. When the storage capacitor C1 is normal, the gate voltage Vg of the driving transistor T8 is 9.3V, the gate-source voltage of the driving transistor T8 is Vgs=4.7V, the gate-source voltage Vgs is greater than the threshold voltage Vth, the driving transistor T8 is in the off state, and the light emitting device D does not emit light. When the storage capacitor C1 is abnormal, the gate voltage Vg of the driving transistor T8 is 6 V, the gate-source voltage Vgs of the driving transistor T8 is 1.4 V, the gate-source voltage Vgs is larger than the threshold voltage Vth, the driving transistor T8 is in an off state, and the light emitting device D does not emit light.

According to the voltage values in Table 1, when the storage capacitor C1 is normal or abnormal, the state shown in Table 2 can be obtained:

TABLE 2

| | Normal | | | | Abnormal | | | |
|---|---|---|---|---|---|---|---|---|
| Vref | Vg | Vgs | T8 | LED | Vg | Vgs | T8 | LED |
| 0 | 3.3 | −1.3 | critical | critical | 0 | −4.6 | on | emit light |
| 2 | 5.3 | 0.7 | Off | Not emit light | 2 | −2.6 | on | emit light |
| 4 | 7.3 | 2.7 | Off | Not emit light | 4 | −0.6 | off | Not emit light |
| 6 | 9.3 | 4.7 | Off | Not emit light | 6 | 1.4 | off | Not emit light |

It should be noted that the first to sixth transistors T1 to T6 and the driving transistor T8 used in the embodiments of the present disclosure are all P-type transistors, and are turned on when the voltages at the gate electrodes thereof are at a low level and are turned off when the voltages at the gate electrodes thereof are at a high level. In order to differentiate the two electrodes of the transistors other than the gate electrode, and the source electrode is referred to as the first electrode, and the drain electrode is referred to as the second electrode. The first power voltage Vdd inputted by the first power voltage terminal VDD is at a high level, and the second power voltage Vss inputted by the second power voltage terminal VSS is at a low level.

Of course, the first to sixth transistors T1 to T6 and the driving transistor T8 used in the embodiments of the present disclosure may also be N-type transistors, which are turned on when the voltages at the gate electrodes thereof are at a high level, and turned off when the voltages at the gate electrodes thereof are at a low level. Furthermore, the reset signal inputted by the reset signal terminal Reset, the gate signal inputted by the gate line Gate, and the light emitting signal inputted by the light emitting signal terminal EM are different from those of the P-type transistor.

Figure 6:
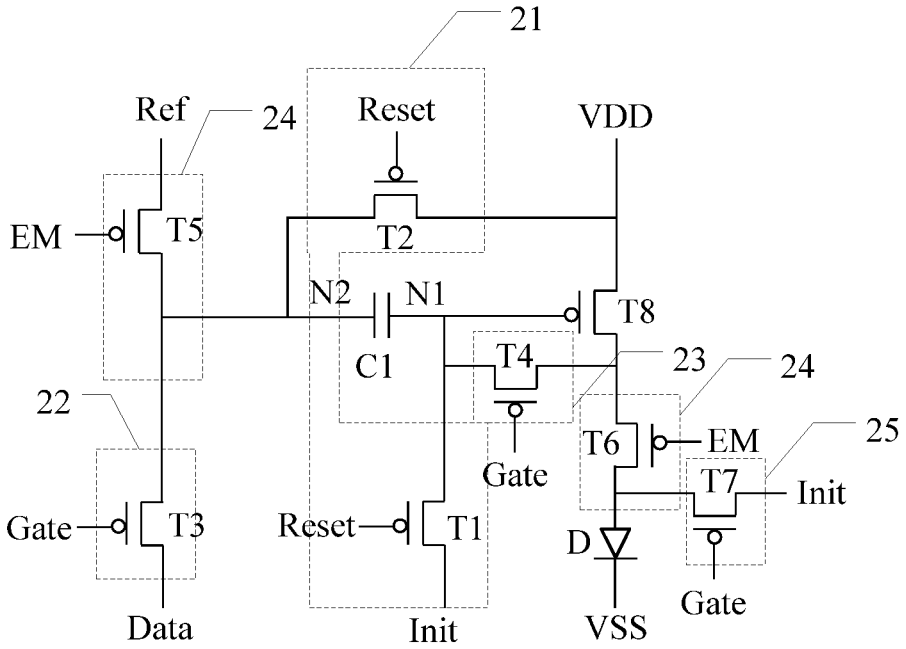
FIG. 6 shows a circuit diagram of another pixel driving circuit provided by some embodiments of the present disclosure.

FIG. 6 shows a circuit diagram of another pixel driving circuit according to some embodiments of the present disclosure.

On the basis of FIG. 5, the pixel driving circuit further includes a second reset sub-circuit 25, the second reset sub-circuit 25 includes a seventh transistor T7, and the gate electrode of the seventh transistor T7 is connected to the gate line Gate, the first electrode of the seventh transistor T7 is connected to the initial voltage signal terminal Init, and the second electrode of the seventh transistor T7 is connected to the anode of the light emitting device D.

At the second stage T2, the gate signal inputted by the gate line Gate is at a low level, the seventh transistor T7 is turned on under the control of the gate signal, and the initial voltage Vinit inputted from the initial voltage signal terminal Init is written into the anode of the light emitting device D, so as to improve the contrast of the light emitting device D.

Of course, the seventh transistor T7 used in the embodiment of the present disclosure is a P-type transistor. Of course, an N-type transistor can also be used.

The light emitting device D may be an organic light emitting diode.

Step 203: when the light emitting states of the light emitting device under the set of measurement voltages all meet a preset abnormal state, determining that the storage capacitor is abnormal.

In the embodiment of the present disclosure, after sequentially inputting a set of measurement voltages Vref having different voltage values to the measurement voltage input terminal Ref of the pixel driving circuit, the light emitting state of the light emitting device D of the pixel driving circuit under each measurement voltage Vref can be detected, and the detected light emitting states are compared with the preset abnormal state table (as shown on the right part of Table 2). When the light emitting states of the light emitting device D meet the preset abnormal states in the preset abnormal state table under the set of measurement voltages Vref, it is determined that the storage capacitor C1 is abnormal.

For example, after sequentially inputting a set of measurement voltages Vref shown in Table 1 to the measurement voltage input terminal Ref of the pixel driving circuit, when the inputted measurement voltage Vref is 0 V, it is detected that the light emitting device D emits light, and when the inputted measurement voltage Vref is 2V, it is detected that the light emitting device D emits light. When the inputted measurement voltage Vref is 4V, it is detected that the light emitting device D does not emit light. When the inputted measurement voltage Vref is 6V, it is detected that the light emitting device D does not emit light. The light emitting states of the light emitting device D all meet the preset abnormal state in Table 2 under the set of measurement voltages Vref, it can be determined that the storage capacitor C1 is abnormal.

Step 204: when the light emitting states of the light emitting device under the set of measured voltages are consistent with a preset normal state table, determining that the storage capacitor is normal.

In the embodiment of the present disclosure, after sequentially inputting a set of measurement voltages Vref having different voltage values to the measurement voltage input terminal Ref of the pixel driving circuit, the light emitting state of the light emitting device D of the pixel driving circuit under each measurement voltage Vref can be detected, and the detected light emitting states are compared with the preset normal state table (as shown on the left part of Table 2). When the light emitting states of the light emitting device D meet the preset normal states in the preset normal state table under the set of measurement voltages Vref, it is determined that the storage capacitor C1 is normal.

For example, after sequentially inputting a set of measurement voltages Vref shown in Table 1 to the measurement voltage input terminal Ref of the pixel driving circuit, when the inputted measurement voltage Vref is 0 V, it is detected that the light emitting device D is in a critical light emitting state; when the inputted measurement voltage Vref is 2V, it is detected that the light emitting device D does not emit light; when the inputted measurement voltage Vref is 4V, it is detected that the light emitting device D does not emit light; when the inputted measurement voltage Vref is 6V, it is detected that the light emitting device D does not emit light. The light emitting states of the light emitting device D meet the preset normal states in the preset normal state table under the set of measurement voltages Vref, it is determined that the storage capacitor C1 is normal.

In the embodiment of the present disclosure, when the driving transistor T8 is turned on, the light emitting device D can be driven to emit light, and the current flowing through the light emitting device D is $I=\frac{1}{2}\mu C_{ox}(W/L)(Vgs-Vth)^2$, where μ is a carrier migration rate. Sub-mobility, $C_{ox}$ is the capacitance of the gate oxide layer, W/L is the width to length ratio of the driving transistor T8, and Vth is the threshold voltage of the driving transistor T8.

It can be seen that the current flowing through the light emitting device D is related to the gate-source voltage Vgs of the driving transistor T8. When the storage capacitor C1 is normal, the gate-source voltage of the driving transistor T8 is Vgs=Vref−Vdata+Vth, when the storage capacitor C1 is abnormal, the gate-source voltage of the driving transistor T8 is Vgs=Vref−Vdd. When the storage capacitor C1 is normal and abnormal, the gate-source voltage Vgs of the driving transistor T8 is different, and the current flowing through the light emitting device D is different, thereby making the brightness of the light emitting device D diffrent. The brightness of the light emitting device D can be detected to determine whether the storage capacitor C1 is normal.

In the embodiment of the present disclosure, a set of measurement voltages with different voltage values are sequentially inputted to the measurement voltage input terminal of the pixel driving circuit, and the light emitting state of the light emitting device in the pixel driving circuit under each measurement voltage is detected. When the light emitting states of the light emitting device under the set of measurement voltages are all consistent with the preset abnormal state table, it is determined that the storage capacitor is abnormal, and when the light emitting states of the light emitting device under the set of measurement voltages are all consistent with the preset normal state table, it is determined that the storage capacitor is normal. Without changing the operation timing of the pixel driving circuit, the measurement voltage inputted by the measurement voltage input terminal is changed, and the switching degree of the driving transistor is controlled by the measurement voltage, thereby controlling whether the light emitting device emits light. It is determined whether the storage capacitor in the pixel driving circuit is normal based on the light emitting state of the light emitting device. The electrical defect caused by the abnormality of the film layer of the capacitor can be quickly detected, and the efficiency of capacitor detection is improved.

For the foregoing embodiments, for the sake of brevity, they are all described as a series of combinations of actions, but those skilled in the art should understand that the present disclosure is not limited by the described order of actions. Some steps can be performed in other orders or at the same time. Secondly, those skilled in the art should also understand that the embodiments described in the disclosure are all optional embodiments, and the actions and circuits are not necessarily required by the present disclosure.

The various embodiments in the present disclosure are described in a progressive manner, and each embodiment focuses on differences from other embodiments, and the similar parts among the embodiments can be referred to each other.

Finally, it should also be noted that the terms such as first and second are used merely to distinguish one entity or operation from another entity or operation, and do not necessarily require or imply that these entities have actual relationship or order. Furthermore, the terms "comprise" or "include" or any other similar term is not exclusive so that a process, method, item or device including a set of elements not only includes these process, method, item or device, but also includes other process, method, item or device that not only clearly mentioned. An element that is defined by the phrase "comprising/include a . . ." does not exclude the presence of additional elements in the process, method, item, or device.

The foregoing is a detailed description of a capacitor detection method. The principles and embodiments of the present disclosure are described herein by using specific examples. The description of the above embodiments only aids for understanding the method and concept of the present disclosure. At the same time, a person skilled in the art may modify the specific embodiments and application scopes according to the concept of the present disclosure, and the contents of the description should not be used to limit the present disclosure.

What is claimed is:

1. A capacitor detection method applied in a pixel driving circuit, comprising:

sequentially inputting a set of measurement voltages having different voltage values to a measurement voltage input terminal of the pixel driving circuit;

detecting a light emitting state of a light emitting device in the pixel driving circuit under each measurement voltage among the set of measurement voltages having different voltage values; and determining whether a storage capacitor in the pixel driving circuit is normal based on the light emitting state of the light emitting device, wherein the pixel driving circuit comprises a first reset sub-circuit, a data writing sub-circuit, a compensation sub-circuit, a light emitting control sub-circuit, a driving transistor, a light emitting device, and a storage capacitor, the first reset sub-circuit is respectively connected to a first terminal of the storage capacitor, a second terminal of the storage capacitor, a reset signal terminal, a first power voltage terminal and an initial voltage signal terminal, and configured to reset the first terminal of the storage capacitor to be the initial voltage, reset the second terminal of the storage capacitor to be the first power voltage;

the data writing sub-circuit is connected to a gate line, a data line, and the second terminal of the storage capacitor, respectively, and configured to write the data voltage to the second terminal of the storage capacitor;

the compensation sub-circuit is respectively connected to the gate line, the driving transistor and the first terminal of the storage capacitor, and configured to write the first power voltage and a threshold voltage of the driving transistor to the first terminal of the storage capacitor;

the light emitting control sub-circuit is respectively connected to a light emitting signal terminal EM, a measurement voltage input terminal, the second terminal of the storage capacitor, the driving transistor and the light emitting device, and is configured to write the measurement voltage inputted by the measurement voltage input terminal to the second terminal of the storage capacitor, and control the driving transistor to drive the light emitting device to emit light;

a gate electrode of the driving transistor is connected to the first terminal of the storage capacitor, a first electrode of the driving transistor is connected to the first power voltage terminal, and a second electrode of the driving transistor is connected to the light emitting control sub-circuit; and an anode of the light emitting device is connected to the light emitting, control sub-circuit, and a cathode of the light emitting device is connected to a second power voltage terminal.

2. The capacitor detection method according to claim 1, wherein the determining whether a storage capacitor in the pixel driving circuit is normal based on the light emitting state of the light emitting device comprises:

determining that the storage capacitor is abnormal when light emitting states of the light emitting device under the set of measurement voltages all meet preset abnormal states; and determining that the storage capacitor is normal when light emitting states of the light emitting device under the set of measurement voltages all meet preset normal states.

3. The capacitor detection method according to claim 1, wherein the first reset sub-circuit includes a first transistor and a second transistor, a gate electrode of the first transistor is connected to the reset signal terminal, a first electrode of first transistor is connected to the initial voltage signal terminal, and a second electrode of the first transistor is connected to the first terminal of the storage capacitor; and a gate electrode of the second transistor is connected to the reset signal terminal, a first electrode of the second transistor is connected to the first power voltage terminal, and a second electrode of the second transistor is connected to the second terminal of the storage capacitor.

4. The capacitor detection method according to claim 3, wherein the data writing sub-circuit includes a third transistor, a gate electrode of the third transistor is connected to the gate line, a first electrode of the third transistor is connected to the data line, and a second electrode of the third transistor is connected to the second terminal of the storage capacitor.

5. The capacitor detection method according to claim 1, wherein the compensation sub-circuit includes a fourth transistor, a gate electrode of the fourth transistor is connected to the gate line, a first electrode of the fourth transistor is connected to the second electrode of the driving transistor, and a second electrode of the fourth transistor is connected to the first terminal of the storage capacitor.

6. The capacitor detection method according to claim 1, wherein the light emitting control sub-circuit includes a fifth transistor and a sixth transistor, a gate electrode of the fifth transistor is connected to the light emitting signal terminal, a first electrode of the fifth transistor is connected to the measurement voltage input terminal, and a second electrode of the fifth transistor is connected to the second terminal of the storage capacitor; and a gate electrode of the sixth transistor is connected to the light emitting signal terminal, a first electrode of the sixth transistor is connected to the second electrode of the driving transistor, and a second electrode of the sixth transistor is connected to the anode of the light emitting device.

7. The capacitor detection method according to claim 6, wherein the first transistor, the second transistor, the third transistor, the fourth transistor, the fifth transistor, the sixth transistor and the driving transistor are all P type transistors.

8. The capacitor detection method according to claim 1, wherein the pixel driving circuit further includes a second reset sub-circuit, the second reset sub-circuit includes a seventh transistor, and a gate electrode of the seventh transistor is connected to the gate line, a first electrode of the seventh transistor is connected to the initial voltage signal terminal, and a second electrode of the seventh transistor is connected to the anode of the light emitting device.

9. The capacitor detection method according to claim 1, wherein the detecting a light emitting state of a light emitting device in the pixel driving circuit under each measurement voltage among the set of measurement voltages having different voltage values comprises:

at a first stage, resetting, by the first reset sub-circuit, the first terminal of the storage capacitor to the initial voltage and the second terminal of the storage capacitor to the first power voltage;

at a second stage, writing, by the data writing sub-circuit, a data voltage to the second terminal of the storage capacitor, and writing, by the compensation sub-circuit, the first power voltage and the threshold voltage of the driving transistor to the first terminal of the storage capacitor; and at a third stage, writing, by the light emitting control sub-circuit, the measurement voltage inputted through the measurement voltage input terminal to the second terminal of the storage capacitor, and adjusting a gate voltage of the driving transistor to detect the light emitting state of the light emitting device.

10. The capacitor detection method according to claim 9, wherein the writing, by the light emitting control sub-circuit, the measurement voltage inputted through the measurement voltage input terminal to the second terminal of the storage capacitor, and adjusting the gate voltage of the driving transistor to detect the light emitting state of the light emitting device comprises:

if the storage capacitor is abnormal, the storage capacitor transferring the measurement voltage to the gate electrode of the driving transistor, when the difference between the measurement voltage and the first power voltage is smaller than the threshold voltage of the driving transistor, driving, by the driving transistor, the light emitting device to emit light under the control of the light emitting control sub-circuit, when the difference between the measurement voltage and the first power voltage is greater than the threshold voltage of the driving transistor, the light emitting device not emitting light.

11. The capacitor detection method according to claim 9, wherein the writing, by the light emitting control sub-circuit, the measurement voltage inputted through the measurement voltage input terminal to the second terminal of the storage capacitor, and adjusting the gate voltage of the driving transistor to detect the light emitting state of the light emitting device comprises:

if the storage capacitor is normal, transferring, by the storage capacitor, the measurement voltage, the data voltage, the first power voltage, and the threshold voltage of the driving transistor to the gate electrode of the driving transistor, when the difference between the measurement voltage and the data voltage is less than zero, driving, by the driving transistor, the light emitting device to emit light under the control of the light emitting control sub-circuit; and when the difference between the measurement voltage and the data voltage is greater than zero, the light emitting device not emitting light.

12. The capacitor detection method according to claim 1, wherein among the set of the measurement voltages having different voltage, there is at least one measurement voltage having a voltage value smaller than a sum of the first power voltage and the threshold voltage of the driving transistor and larger than a data voltage; or there is at least one measurement voltage having a voltage value larger than a sum of the first power voltage and the threshold voltage of the driving transistor and smaller than the data voltage.

13. A pixel driving circuit, comprising a first reset sub-circuit, a data writing sub-circuit, a compensation sub-circuit, a light emitting control sub-circuit, a driving transistor, a light emitting device, and a storage capacitor, wherein the first reset sub-circuit is respectively connected to a first terminal of the storage capacitor, a second terminal of the storage capacitor, a reset signal terminal, a first power voltage terminal and an initial voltage signal terminal, and configured to reset the first terminal of the storage capacitor to be the initial voltage, reset the second terminal of the storage capacitor to be the first power voltage;

the data writing sub-circuit is connected to a gate line, a data line, and the second terminal of the storage capacitor, respectively, and configured to write the data voltage to the second terminal of the storage capacitor;

the compensation sub-circuit is respectively connected to the gate line, the driving transistor and the first terminal of the storage capacitor, and configured to write the first power voltage and a threshold voltage of the driving transistor to the first terminal of the storage capacitor;

the light emitting control sub-circuit is respectively connected to a light emitting signal terminal EM, a measurement voltage input terminal, the second terminal of the storage capacitor, the driving transistor and the light emitting device, and is configured to write the measurement voltage inputted by the measurement voltage input terminal to the second terminal of the storage capacitor, and control the driving transistor to drive the light emitting device to emit light;

a gate electrode of the driving transistor is connected to the first terminal of the storage capacitor, a first electrode of the driving transistor is connected to the first power voltage terminal, and a second electrode of the driving transistor is connected to the light emitting control sub-circuit;

an anode of the light emitting device is connected to the light emitting control sub-circuit, and a cathode of the light emitting device is connected to a second power voltage terminal; and a set of measurement voltages having different voltage values are inputted to a measurement voltage input terminal of the pixel driving circuit, a light emitting state of a light emitting device under each measurement voltage is detected, and it is determined whether a storage capacitor in the pixel driving circuit is normal based on the light emitting state of the light emitting device.

14. The pixel driving circuit according to claim 13, wherein the first reset sub-circuit includes a first transistor and a second transistor, a gate electrode of the first transistor is connected to the reset signal terminal, a first electrode of first transistor is connected to the initial voltage signal terminal, and a second electrode of the first transistor is connected to the first terminal of the storage capacitor; and a gate electrode of the second transistor is connected to the reset signal terminal, a first electrode of the second transistor is connected to the first power voltage terminal, and a second electrode of the second transistor is connected to the second terminal of the storage capacitor.

15. The pixel driving circuit according to claim 14, wherein the data writing sub-circuit includes a third transistor, a gate electrode of the third transistor is connected to the gate line, a first electrode of the third transistor is connected to the data line, and a second electrode of the third transistor is connected to the second terminal of the storage capacitor.

16. The pixel driving circuit according to claim 15, wherein the compensation sub-circuit includes a fourth transistor, a gate electrode of the fourth transistor is connected to the gate line, a first electrode of the fourth transistor is connected to the second electrode of the driving transistor, and a second electrode of the fourth transistor is connected to the first terminal of the storage capacitor.

17. The pixel driving circuit according to claim 16, wherein the light emitting control sub-circuit includes a fifth transistor and a sixth transistor, a gate electrode of the fifth transistor is connected to the light emitting signal terminal, a first electrode of the fifth transistor is connected to the measurement voltage input terminal, and a second electrode of the fifth transistor is connected to the second terminal of the storage capacitor; and a gate electrode of the sixth transistor is connected to the light emitting signal terminal, a first electrode of the sixth transistor is connected to the second electrode of the driving transistor, and a second electrode of the sixth transistor is connected to the anode of the light emitting device.

18. The pixel driving circuit according to claim 17, wherein the first transistor, the second transistor, the third transistor, the fourth transistor, the fifth transistor , the sixth transistor and the driving transistor are all P type transistors.

19. The pixel driving circuit according to claim 13, wherein the pixel driving circuit further includes a second reset sub-circuit, the second reset sub-circuit includes a seventh transistor, and a gate electrode of the seventh transistor is connected to the gate line, a first electrode of the seventh transistor is connected to the initial voltage signal terminal, and a second electrode of the seventh transistor is connected to the anode of the light emitting device.

* * * * *